US011166583B2

(12) United States Patent
Liu

(10) Patent No.: US 11,166,583 B2
(45) Date of Patent: Nov. 9, 2021

(54) CHRISTMAS TREE CONNECTING ROD ASSEMBLY

(71) Applicant: Haitang Liu, Jingzhou (CN)

(72) Inventor: Haitang Liu, Jingzhou (CN)

( * ) Notice: Subject to any disclaimer, the term of this patent is extended or adjusted under 35 U.S.C. 154(b) by 0 days.

(21) Appl. No.: 17/074,627

(22) Filed: Oct. 20, 2020

(65) Prior Publication Data

US 2021/0030186 A1 Feb. 4, 2021

(51) Int. Cl.

| | |
|---|---|
| ***A47G 33/06*** | (2006.01) |
| ***A47G 33/08*** | (2006.01) |
| ***F21V 23/00*** | (2015.01) |
| *F21W 121/04* | (2006.01) |

(52) U.S. Cl.

CPC ..... *A47G 33/06* (2013.01); *A47G 33/08* (2013.01); *F21V 23/002* (2013.01); *A47G 2033/0827* (2013.01); *F21W 2121/04* (2013.01)

(58) Field of Classification Search

CPC ..... A41G 1/005; A41G 1/007; A47G 33/06; F21V 23/06

See application file for complete search history.

(56) References Cited

U.S. PATENT DOCUMENTS

| | | | | |
|---|---|---|---|---|
| 3,970,834 | A * | 7/1976 | Smith | A47G 33/06 362/123 |
| 7,144,610 | B1 * | 12/2006 | Estes | A47B 97/00 428/19 |
| 2007/0230174 | A1 * | 10/2007 | Hicks | F21S 13/14 362/249.16 |
| 2009/0289560 | A1 * | 11/2009 | Oliva | A41G 1/002 315/185 S |
| 2010/0196628 | A1 * | 8/2010 | Shooley | A47G 33/06 428/19 |
| 2013/0120971 | A1 * | 5/2013 | Chen | F21V 21/002 362/123 |

* cited by examiner

*Primary Examiner* — Evan P Dzierzynski

(57) ABSTRACT

The present disclosure relates to the field of light-emitting decorative craft, and in particular, to a Christmas tree connecting rod assembly. A branch connecting rod is assembled with a branch mounting rod, and a first connecting contact assembly is electrically connected to a second connecting contact assembly. Therefore, the entire connecting rod assembly achieves circuit communication through the first connecting contact assembly and the second connecting contact assembly. In addition, all wires are routed internally, so that electrical wires are prevented from being directly arranged on the trunk of a Christmas tree, making the Christmas tree decoration more beautiful.

6 Claims, 4 Drawing Sheets

CHRISTMAS TREE CONNECTING ROD ASSEMBLY

TECHNICAL FIELD

The present disclosure relates to the field of light-emitting decorative craft, and in particular, to a Christmas tree connecting rod assembly.

BACKGROUND

As China's international status in the international society is getting higher and higher, the Chinese society becomes increasingly inclusive and gradually recognizes and appreciates different cultures. Currently, foreign festivals are somewhat accepted in China. Christmas trees are set up at streets, supermarkets, pubs and even homes around Christmas for celebration.

At present, electrical wires are arranged on trunk surfaces of most commercially available Christmas trees. Such an arrangement causes undesirable appearance and safety hazards and makes it difficult to mount or demount the Christmas trees.

SUMMARY

To solve the foregoing problem, the present disclosure provides a Christmas tree connecting rod assembly. A first connecting contact assembly and a second connecting contact assembly are used to implement circuit communication, and ail wires are routed internally, so that electrical wires are prevented from being directly arranged on the trunk of a Christmas tree, making the Christmas tree decoration more beautiful.

To achieve the foregoing objective, the technical scheme adopted in the present disclosure is a Christmas tree connecting rod assembly, including a branch mounting rod connected to a main rod of the Christmas tree and a branch connecting rod detachably connected to the branch mounting rod, wherein an outer side wall of the branch connecting rod is provided with a first connecting contact assembly which is electrically connected to a first connecting plug located at an end of the branch connecting rod by an electrical wire, and the outer side wall of the branch connecting rod is further provided with a threaded lug distributed in a circumferential direction of the branch connecting rod; an inner side wall of the branch mounting rod is provided with a second connecting contact assembly corresponding to the first connecting contact assembly, the second connecting contact assembly is electrically connected to a second connecting plug located at an end of the branch mounting rod by an electrical wire, and the inner side wall of the branch mounting rod is further provided with a threaded groove corresponding to the threaded lug, wherein the branch connecting rod is assembled with the branch mounting rod by fitting the threaded groove with the threaded lug, the branch connecting rod rotates in a direction of the threaded groove, and the first connecting contact assembly is electrically connected to the second connecting contact assembly.

Preferably, the branch connecting rod includes a first connecting sleeve rod, a second connecting sleeve rod, and a third connecting sleeve rod that are sequentially integrated and are in communication with each other, outer diameters of the first connecting sleeve rod; the second connecting sleeve rod, and the third connecting sleeve rod sequentially ascend, and the threaded lug and the first connecting contact assembly are both disposed on an outer side wall of the second connecting sleeve rod.

Preferably, the branch mounting rod includes a fourth connecting sleeve rod and a fifth connecting sleeve rod that are sequentially integrated and are in communication with each other, and outer diameters of the fourth connecting sleeve rod and the fifth connecting sleeve rod sequentially ascend; and a first limit step is provided between the first connecting sleeve rod and the second connecting sleeve rod, a second limit step is provided between the second connecting sleeve rod and the third connecting sleeve rod; the branch mounting rod is assembled with the branch connecting rod, the fifth connecting sleeve rod is sleeved over the second connecting sleeve rod, an end of the fifth connecting sleeve rod abuts against the first limit step, the fourth connecting sleeve rod is sleeved over the first connecting sleeve rod, and an end of the fourth connecting sleeve rod abuts against the second limit step.

Preferably, the second connecting contact assembly includes a contact fixing support and several second connecting contacts fixed on the contact fixing support, an outer side wall of the fifth connecting sleeve rod is provided with several assembly openings aligned with the second connecting contacts, each side of each assembly opening is provided with a positioning post, the contact fixing support is provided with a positioning hole corresponding to the positioning post, the positioning post is inserted in the positioning hole of the contact fixing support, and the second connecting contacts and the assembly openings are aligned with each other.

Preferably, a first sleeve is further sleeved over an outer side wall of the third connecting sleeve rod.

Preferably, a second sleeve is sleeved over an outer side wall of the fourth connecting sleeve rod, and the fifth connecting sleeve rod is located inside the second sleeve.

The beneficial effects of the present disclosure are as follows:

(1) In the present disclosure, the outer side wall of the branch connecting rod is provided with a first connecting contact assembly which is electrically connected to the first connecting plug located at the end of the branch connecting rod by an electrical wire. The inner side wall of the branch mounting rod is provided with the second connecting contact assembly corresponding to the first connecting contact assembly, and the second connecting contact assembly is electrically connected to the second connecting plug located at the end of the branch mounting rod by an electrical wire. The branch connecting rod is assembled with the branch mounting rod, and the first connecting contact assembly is electrically connected to the second connecting contact assembly. Therefore, for the entire connecting rod assembly, the first connecting contact assembly and the second connecting contact assembly are used to implement circuit communication, and all wires are routed internally, so that electrical wires are prevented from being directly arranged on the trunk of a Christmas tree, making the Christmas tree decoration more beautiful.

(2) In the present disclosure, the branch connecting rod is assembled with the branch mounting rod by fitting the threaded groove with the threaded lug, the branch connecting rod rotates in the direction of the threaded groove, and the first connecting contact assembly is electrically connected to the second connecting contact assembly. The fit between the threaded lug and the threaded groove facilitates the mounting and dismounting of the branch connecting rod and the branch mounting rod, so that the overall assembly, efficiency of the Christmas tree can be greatly improved: The first connecting contact assembly is electrically connected to the second connecting contact assembly, that is, any branch connecting rod may be assembled with the branch mounting rod to implement circuit communication, so that the assembly is very convenient.

Figure 1:
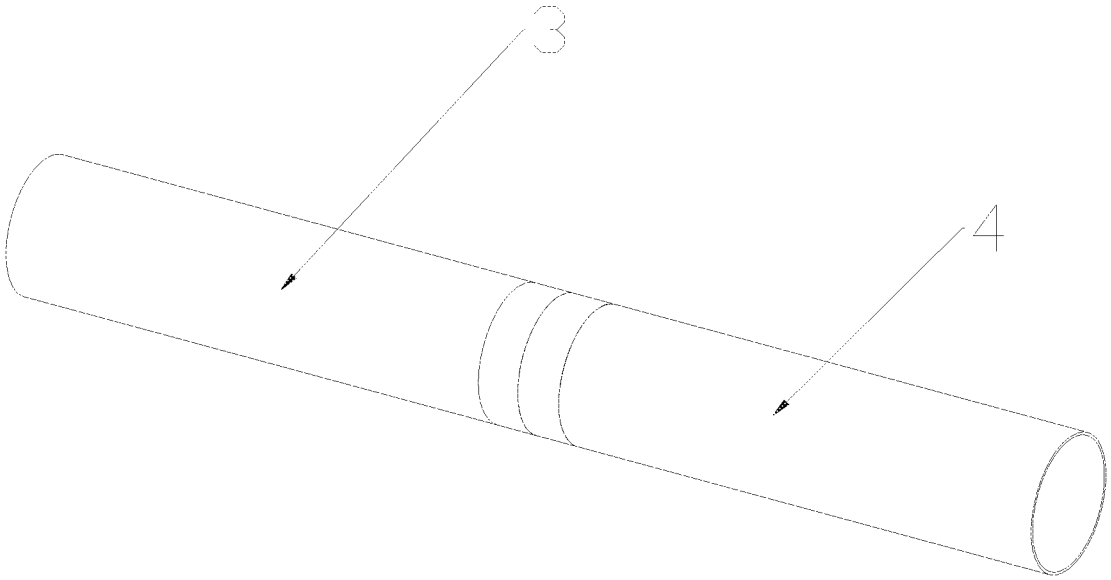
FIG. 1 is an overall schematic structural diagram according to the present disclosure.

Reference numerals: branch connecting rod 1, first connecting sleeve rod 11, first limit step 111, second limit step 112, second connecting sleeve rod 12, first connecting contact assembly 121, threaded lug 122, third connecting sleeve rod 13, branch mounting rod 2, contact fixing support 21, second connecting contact 22, positioning hole 23, fourth connecting sleeve rod 24, fifth connecting sleeve rod 25, assembly opening 251, positioning post 252, threaded groove 253, first sleeve 3, second sleeve 4, main rod 5, decorative light source 6, and branch 7.

DETAILED DESCRIPTION

Figure 2:
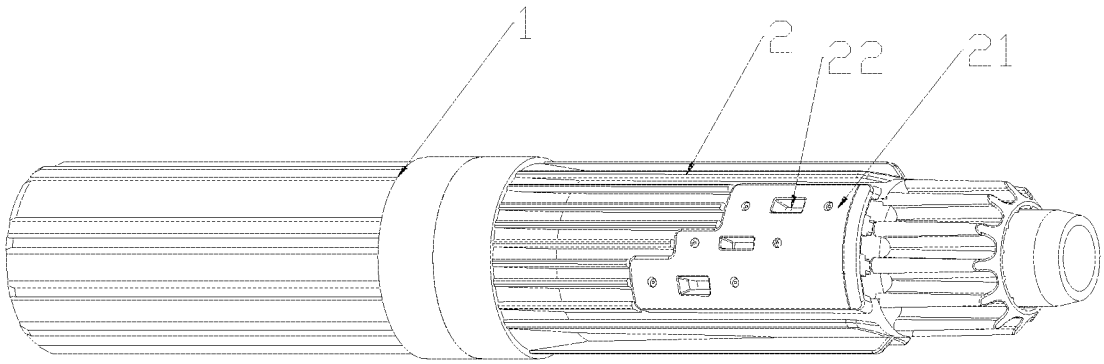
FIG. 2 is schematic structural diagram based on FIG. 1 with a first sleeve and a second sleeve omitted.
Figure 3:
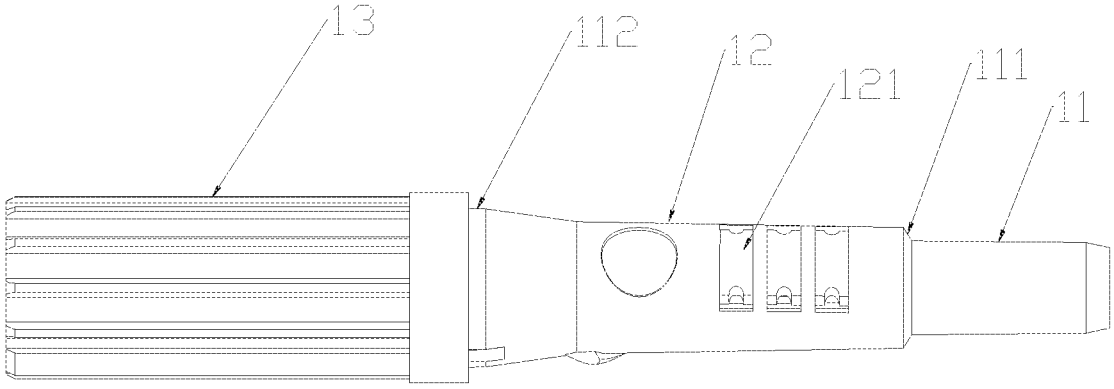
FIG. 3 is a schematic structural diagram of a branch connecting rod.
Figure 4:
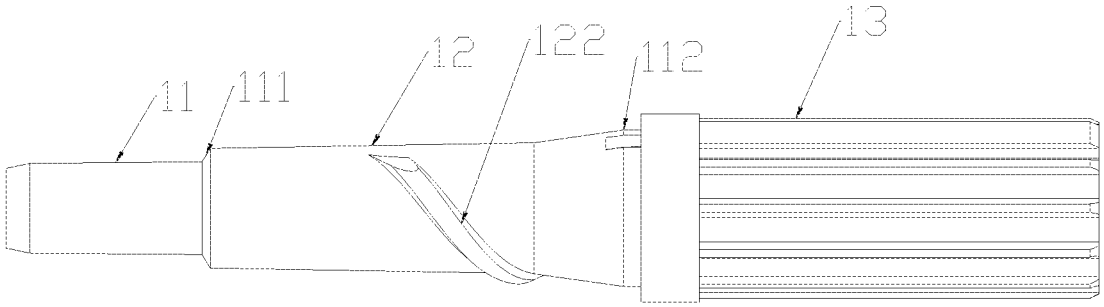
FIG. 4 is a schematic structural diagram of a branch connecting rod from another viewing angle.
Figure 5:
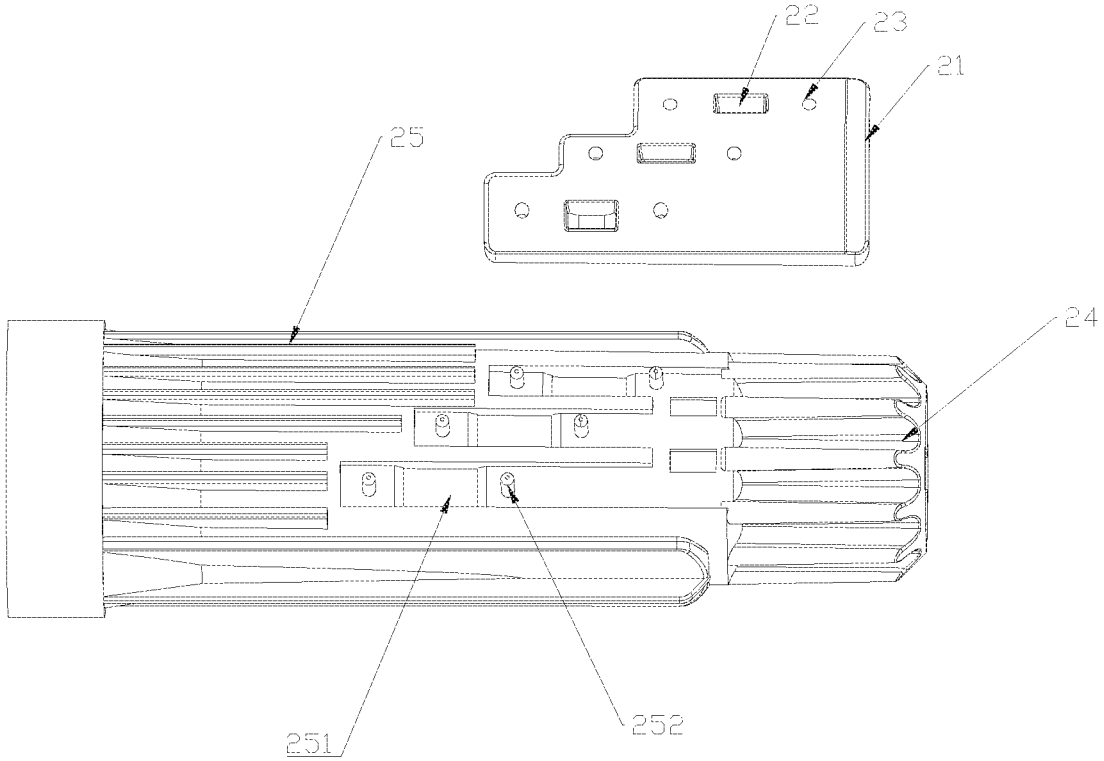
FIG. 5 is an exploded schematic structural view of a branch mounting rod.
Figure 6:
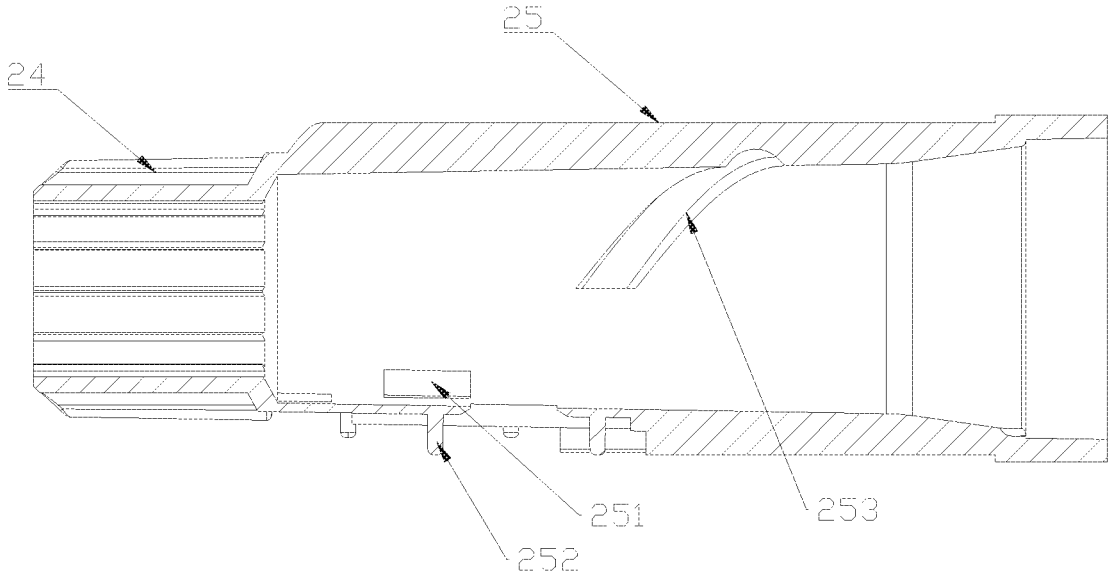
FIG. 6 is a schematic structural view of a longitudinal section of a branch mounting rod.
Figure 7:
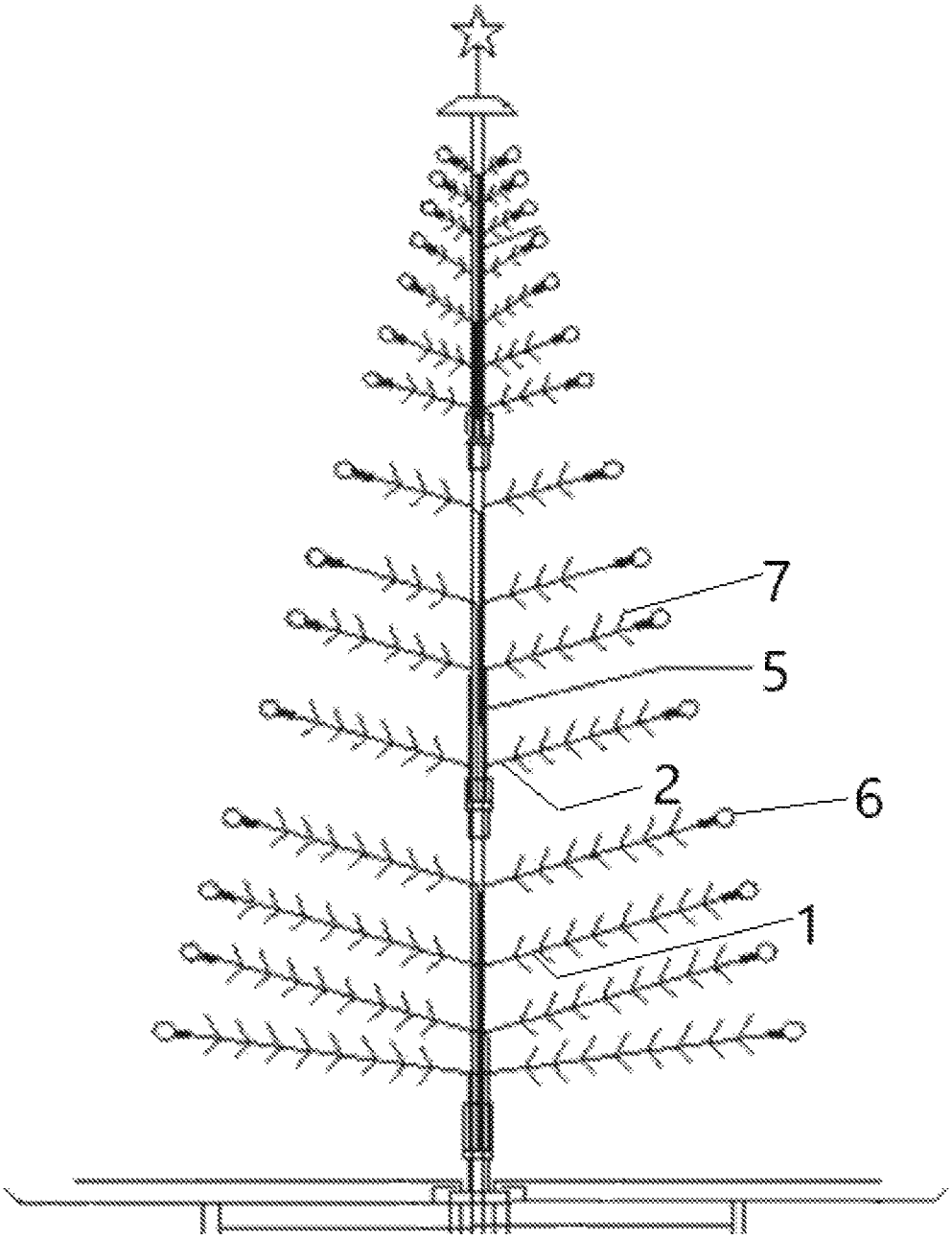
FIG. 7 is a schematic structural diagram of applying a connecting rod assembly of the present disclosure to a Christmas tree.

Referring to FIG. 1 to FIG. 7, the present disclosure relates to a Christmas tree connecting rod assembly, including a branch mounting rod 2 connected to a main rod 5 of a Christmas tree and a branch connecting rod 1 detachably connected to the branch mounting rod 2. An outer side wall of the branch connecting rod 1 is provided with a first connecting contact assembly 121. The first connecting contact assembly 121 is electrically connected to a first connecting plug located at an end of the branch connecting rod 1 by an electrical wire. The outer side wall of the branch connecting rod 1 is provided with a threaded lug 122 distributed in a circumferential direction of the branch connecting rod 1. An inner side wall of the branch mounting rod 2 is provided with a second connecting contact 22 assembly corresponding to the first connecting contact assembly 121. The second connecting contact 22 assembly is electrically connected to a second connecting plug located at an end of the branch mounting rod 2 by an electrical wire. The inner side wall of the branch mounting rod 2 is further provided with a threaded groove 253 corresponding to the threaded lug 122. The branch connecting rod 1 is assembled with the branch mounting rod 2 by fitting the threaded groove 253 with the threaded lug 122. The branch connecting rod 1 rotates in a direction of the threaded groove 253. The first connecting contact assembly 121 is electrically connected to the second connecting contact 22 assembly.

The working principle of the present disclosure is as follows:

A user may insert an end of the branch mounting rod 2 in the main rod 5 of the Christmas tree (the main rod 5 of the Christmas tree is provided with several mounting openings for fitting the branch mounting rod 2), and connects the second connecting plug at the end of the branch mounting rod 2 to a corresponding plug in the main rod 5 of the Christmas tree (the mounting openings of the main rod 5 of the Christmas tree are provided with several plugs for adapting to the second connecting plug). Then, the user assembles the branch connecting rod 1 with the branch mounting rod 2 by fitting the threaded groove 253 with the threaded lug 122. The branch connecting rod 1 is rotated in a direction of the threaded groove 253. The first connecting contact assembly 121 is electrically connected to the second connecting contact 22 assembly. Next, the branch connecting rod 1 is assembled with several branches 7 according to actual needs. Finally, a decorative light source 6 is externally connected through the first connecting plug, and is hung on the branches 7 to decorate the Christmas tree.

Next, in the present disclosure, the outer side wall of the branch connecting rod 1 is provided with the first connecting contact assembly 121. The first connecting contact assembly 121 is electrically connected to the first connecting plug located at the end of the branch connecting rod 1 by an electrical wire. The inner side wall of the branch mounting rod 2 is provided with the second connecting contact 22 assembly corresponding to the first connecting contact assembly 121. The second connecting contact 22 assembly is electrically connected to the second connecting plug located at the end of the branch mounting rod 2 by an electrical wire. The branch connecting rod 1 is assembled with the branch mounting rod 2. The first connecting contact assembly 121 is electrically connected to the second connecting contact 22 assembly. Therefore, for the entire connecting rod assembly, the first connecting contact assembly 121 and the second connecting contact 22 assembly are used to implement circuit communication. All wires are routed internally, so that electrical wires are prevented from being directly arranged on the trunk of a Christmas tree, making the Christmas tree decoration more beautiful.

In the present disclosure, the branch connecting rod 1 is assembled with the branch mounting rod 2 by fitting the threaded groove 253 with the threaded lug 122. The branch connecting rod 1 is rotated in the direction of the threaded groove 253, and the first connecting contact assembly 121 is electrically connected to the second connecting contact 22 assembly. The fit between the threaded lug 122 and the threaded groove 253 facilitates the mounting and dismounting of the branch connecting rod 1 and the branch mounting rod 2, so that the overall assembly efficiency of the Christmas tree can be greatly improved. The first connecting contact assembly 121 is electrically connected to the second connecting contact 22 assembly, that is, any branch connecting rod 1 may be assembled with the branch mounting rod 2 to implement circuit communication, so that the assembly is very convenient.

Preferably, the branch connecting rod 1 includes a first connecting sleeve rod 11, a second connecting sleeve rod 12, and a third connecting sleeve rod 13 that are sequentially integrated and are in communication with each other. Outer diameters of the first connecting sleeve rod 11, the second connecting sleeve rod 12, and the third connecting sleeve rod 13 sequentially ascend. The threaded lug 122 and the first connecting contact assembly 121 are both disposed on an outer side wall of the second connecting sleeve rod 12. The branch mounting rod 2 includes a fourth connecting sleeve rod 24 and a fifth connecting sleeve rod 25 that are sequentially integrated and are in communication with each other. Outer diameters of the fourth connecting sleeve rod 24 and the fifth connecting sleeve rod 25 sequentially ascend. A first limit step 111 is provided between the first connecting sleeve rod 11 and the second connecting sleeve rod 12. A second limit step 112 is provided between the second connecting sleeve rod 12 and the third connecting sleeve rod 13. The branch mounting rod 2 is assembled with the branch connecting rod 1. The fifth connecting sleeve rod 25 is sleeved over the second connecting sleeve rod 12. An end of the fifth connecting sleeve rod 25 abuts against the first limit step 111. The fourth connecting sleeve rod 24 is sleeved over the first connecting sleeve rod 11. An end of the fourth connecting sleeve rod 24 abuts against the second limit step 112.

In this specific embodiment, with the design of the first limit step 111 and the second limit step 112, the branch connecting rod 1 and the branch mounting rod 2 can be conveniently assembled in position. When the branch connecting rod 1 rotates in the direction of the threaded groove 253 and is mounted in position, the end of the fifth connecting sleeve rod 25 abuts against the first limit step 111, and the end of the fourth connecting sleeve rod 24 abuts against the second limit step 112, so that it can be ensured that the first connecting contact assembly 121 can be accurately electrically connected to the second connecting contact 22 assembly.

Preferably, the second connecting contact 22 assembly includes a contact fixing support 21 and several second connecting contacts 22 fixed on the contact fixing support 21. An outer side wall of the fifth connecting sleeve rod 25 is provided with several assembly openings 251 aligned with the second connecting contacts 22. Each side of each assembly opening 251 is provided with a positioning post 252. The contact fixing support 21 is provided with a positioning hole 23 corresponding to the positioning post 252. The positioning post 252 is inserted in the positioning hole 23 of the contact fixing support 21. The second connecting contacts 22 and the assembly openings 251 are aligned with each other. In this specific embodiment, the second connecting contact 22 assembly is assembled on the branch mounting rod 2 in a detachable manner. Even if damage occurs in the second connecting contact 22 assembly and repair is needed, the contact fixing support 21 may be directly detached from the assembly openings 251 for replacement.

Preferably, a first sleeve 3 is further sleeved over an outer side wall of the third connecting sleeve rod 13. The first sleeve 3 is used to protect the branch connecting rod 1.

Preferably, a second sleeve 4 is sleeved over an outer side wall of the fourth connecting sleeve rod 24. The fifth connecting sleeve rod 25 is located inside the second sleeve 4. The second sleeve 4 can protect the branch mounting rod 2 and at the same time can facilitate cabling.

The foregoing implementations are merely descriptions of preferred implementations of the present disclosure and are not used to limit the scope of the present disclosure. Various variations and improvements made by a person of ordinary skill in the art to the technical schemes of the present disclosure without departing from the design spirit of the present disclosure shall fall within the protection scope determined by the claims of the present disclosure.

The invention claimed is:

1. A Christmas tree connecting rod assembly, comprising a branch mounting rod connected to a main rod of a Christmas tree and a branch connecting rod detachably connected to the branch mounting rod, wherein an outer side wall of the branch connecting rod is provided with a first connecting contact assembly which is electrically connected to a first connecting plug located at an end of the branch connecting rod by an electrical wire, and the outer side wall of the branch connecting rod is provided with a threaded lug distributed in a circumferential direction of the branch connecting rod; an inner side wall of the branch mounting rod is provided with a second connecting contact assembly corresponding to the first connecting contact assembly, the second connecting contact assembly is electrically connected to a second connecting plug located at an end of the branch mounting rod by an electrical wire, and the inner side wall of the branch mounting rod is further provided with a threaded groove corresponding to the threaded lug, wherein the branch connecting rod is assembled with the branch mounting rod by fitting the threaded groove with the threaded lug, the branch connecting rod rotates in a direction of the threaded groove, and the first connecting contact assembly is electrically connected to the second connecting contact assembly.

2. The Christmas tree connecting rod assembly according to claim 1, wherein the branch connecting rod comprises a first connecting sleeve rod, a second connecting sleeve rod, and a third connecting sleeve rod that are sequentially integrated and are in communication with each other, outer diameters of the first connecting sleeve rod, the second connecting sleeve rod, and the third connecting sleeve rod sequentially ascend, and the threaded lug and the first connecting contact assembly are both disposed on an outer side wall of the second connecting sleeve rod.

3. The Christmas tree connecting rod assembly according to claim 2, wherein the branch mounting rod comprises a fourth connecting sleeve rod and a fifth connecting sleeve rod that are sequentially integrated and are in communication with each other, and outer diameters of the fourth connecting sleeve rod and the fifth connecting sleeve rod sequentially ascend; and a first limit step is provided between the first connecting sleeve rod and the second connecting sleeve rod, a second limit step is provided between the second connecting sleeve rod and the third connecting sleeve rod, the branch mounting rod is assembled with the branch connecting rod, the fifth connecting sleeve rod is sleeved over the second connecting sleeve rod, an end of the fifth connecting sleeve rod abuts against the first limit step, the fourth connecting sleeve rod is sleeved over the first connecting sleeve rod, and an end of the fourth connecting sleeve rod abuts against the second limit step.

4. The Christmas tree connecting rod assembly according to claim 2, wherein the second connecting contact assembly comprises a contact fixing support and several second connecting contacts fixed on the contact fixing support, an outer side wall of the fifth connecting sleeve rod is provided with several assembly openings aligned with the second connecting contacts, each side of each assembly opening is provided with a positioning post, the contact fixing support is provided with a positioning hole corresponding to the positioning post, the positioning post is inserted in the positioning hole of the contact fixing support, and the second connecting contacts and the assembly openings are aligned with each other.

5. The Christmas tree connecting rod assembly according to claim 2, wherein a first sleeve is further sleeved over an outer side wall of the third connecting sleeve rod.

6. The Christmas tree connecting rod assembly according to claim 3, wherein a second sleeve is sleeved over an outer side wall of the fourth connecting sleeve rod, and the fifth connecting sleeve rod is located inside the second sleeve.

* * * * *